US005940930A

United States Patent [19]

Oh et al.

[11] Patent Number: 5,940,930

[45] Date of Patent: Aug. 24, 1999

[54] REMOTE CONTROLLED VACUUM CLEANER

[75] Inventors: Jang-Keun Oh; Jeong-gon Song; Young-Poung No, all of Kwangju, Rep. of Korea

[73] Assignee: Samsung Kwang-Ju Electronics Co., Ltd., Kwangju, Rep. of Korea

[21] Appl. No.: 08/985,001

[22] Filed: Dec. 4, 1997

[30] Foreign Application Priority Data

May 12, 1997 [KR] Rep. of Korea ..... 97-10533

[51] Int. Cl.[6] ..... A47L 5/32

[52] U.S. Cl. ..... 15/335; 15/319

[58] Field of Search ..... 15/319, 328, 331, 15/334, 335

[56] References Cited

U.S. PATENT DOCUMENTS

| | | | |
|---|---|---|---|
| 1,204,718 | 11/1916 | Vander Putten | 15/334 |
| 4,369,543 | 1/1983 | Chen et al. | 15/319 |
| 4,513,469 | 4/1985 | Godfrey et al. | 15/319 |
| 5,144,714 | 9/1992 | Mori et al. | 15/319 |
| 5,247,720 | 9/1993 | Sovis et al. | 15/334 |
| 5,293,665 | 3/1994 | Worwag | 15/328 |
| 5,669,098 | 9/1997 | Tono | 15/321 |

*Primary Examiner*—Terrence R. Till

*Attorney, Agent, or Firm*—Majestic, Parsons, Siebert & Hsue P.C.

[57] ABSTRACT

This invention relates to a remote controlled vacuum cleaner comprising a motor installed in a chamber inside a main body, for creating a suction, a dust collecting bag installed at a dust collecting compartment, for collecting the dirt and dust sucked by the suction from the motor, left and right wheels for moving the main body, the wheels being driven by left/right wheel driving portions, auxiliary wheel installed at a front lower portion of the main body and rotated together with the rotating right and left wheels, a suction inlet installed at a front lower portion of the main body, which is connected to the dust collecting compartment by way of a suction duct, characterized in that an auxiliary suction inlet is arranged at a front lower portion of the main body, the auxiliary suction inlet being opened or closed in a sliding fashion. There are provided a manual operation of the cleaner by using a hose, thereby providing a convenience for a user and an improved practical use thereof.

2 Claims, 5 Drawing Sheets

REMOTE CONTROLLED VACUUM CLEANER

BACKGROUND OF THE INVENTION

1. Field of the Invention

The present invention relates to a vacuum cleaner for cleaning the dirt and dust by sucking air through the use of mechanical means and, more particularly, to a remote controlled vacuum cleaner which combines a manual operational mode with a remote control mode.

2. Description of the Prior Art

As shown in FIG. 1, popular manual vacuum cleaner has a main body 41 provided therein with a chamber 61 which is formed by an isolating wall (not shown). The chamber 61 is provided therein with a motor 43 which creates the suction and of which a side is located a dust collecting compartment 62 having a dust collecting bag 6 used for collecting dust and foreign materials sucked into the body when the motor 43 is activated.

Further, under the motor 43, there is provided left and right wheels 42, 44 arranged at left and right sides of the main body 41, respectively, and for moving the main body 41. Below the dust collecting compartment 62, there is provided an auxiliary wheel 49 centrally located with respect to the body 41 and for supporting the main body 41. At a front side of the body 41 is provided with suction inlet 50 incorporating inside thereof a suction hose 48 adapted to guide air flow containing the dirt and dust sucked by sucking means (not shown) into the dust collecting bag 45.

In such a conventional manual-type vacuum cleaner, when an operation switch is manipulated by a user, electric power carried through power line 47 is supplied into the motor 43 and then the driven motor 43 creates the suction capable of sucking dust, foreign materials, etc. deposited on any places to be cleaned. The sucked materials is fed through the sucking means and hose 48 into the main body 41 and then into the dust collecting bag 45 in the dust collecting compartment 62, to complete the cleaning.

With a handle installed at a connecting pipe, a user may pull or push the cleaner to reach other place to be cleaned. Rotation of left and right wheels 42, 44 and auxiliary wheel 49 allows an easy movement of the cleaner towards the selected place, where the cleaning of the place is made through the repeated cleaning actions.

For such manually operated vacuum cleaner, however, a user is required to move together with the vacuum cleaner for the cleaning. This causes excessive fatigue of a user, and therefore inconvenience for a user is induced.

To overcome the above-mentioned problems, automatically driven-type of vacuum cleaners are recently being developed, among which a remote controlled vacuum cleaner will be discussed through the present specification. In FIGS. 1 and 2, like elements are assigned like reference numerals.

FIG. 2 is a vertical sectional view of a main body of a remote controlled automatic vacuum cleaner. This cleaner is provided with a suction inlet 51 disposed at a front lower side thereof and for sucking the dirt and dust under a remote control mode, with the suction inlet 50 (see FIG. 1) to which the hose 48 is installed for a manual operation being closed.

Further, the suction inlet 51 is coupled to the dust collecting bag 45 by way of a suction duct 53.

Still further, left and right wheels 42, 44 of the main body 100 are driven by respective right and left motor driving portions 132, 134 whose details will be described later, to move the vacuum cleaner in a direction as desired.

FIG. 3 is a schematic block diagram for explaining an embodiment of the remote controlled vacuum cleaner in FIG. 3, this remote system consisting of a remote controller 10 and the main body 100.

The remote controller 10 generates a signal to be used for remotely controlling the main body 100 in response to a user manipulation, preferably which may be a joystick. As shown in FIG. 4, the employed joystick has a adjustable contact 11, four contacts 12 to 15 for respective directions, an operational key 16, an encoder 17 and a transmitting stage 18.

When a handle of the joystick is moved by a user, the adjustable contact 11 is thus moved to contact with one of the four contacts. Any one contact engaged with the adjustable contact 11 causes a contact signal to be generated, which is supplied to the encoder 16. The operation key 16 generates a operation key signal in response to a user's manipulation.

An encoded operational key signal and contact signals from the respective contacts 12 to 15 are output from the encoder 17 and then forwarded to the transmitting stage 18 which transmits subsequently to the main body 100 the encoded signals modulated with the carrier wave.

Further, the main body 100, as shown in FIG. 3, includes a decoder 115, a controller 120, left and right wheel motor driving portions 132 and 134 and a motor driving portion 136. The decoder 115 receives a remote controlling signal transmitted from the remote controller 10 and supplies it to the controller 120, and the controller 120 generates, in response thereto, a control signal for causing the main body 110 to be operated to clean a place and for moving the body 100 in the desired direction.

The left wheel motor driving portion 132 drives the left wheel 42 in response to the drive control signal from the controller 120, and the right wheel motor driving portion 132 drives the right wheel 42 in response to the drive control signal from the controller 120. The motor driving portion 136 drives the motor 43 in response to the drive control signal from the controller 120.

The operational procedures of the remote controlled vacuum cleaner thus constructed will be in detail described with reference to FIGS. 2 and 4.

A user may manipulate the remote controller 10, i.e., preferably joystick having the operational key 16 thereon. The key 16 sends the operational key signal therefrom to the encoder 18, which encodes the received signal and then provides it to the transmitting stage 18. The stage 18 modulates the received signal with the carrier signal to transmit it through an antenna to the main body 100. A receiving antenna at the main body receives the transmitted signal, which is forwarded the decoder 115. The decoded signal is provided to the controller 120.

Subsequently, the controller 120 generates a control signal for driving the motor 43 equipped in the main body 100, wherein the driving of the motor 43 is made through the motor driving portion 136 receiving the control signal. The activated motor 43 creates the suction suitable for sucking the dirt and dust on such as the floor through a suction brush (not illustrated). Foreign materials then pass through a connecting pipe 48 and then the suction inlet 50, finally collected in the dust collecting compartment 62.

Meanwhile, for a user to move the main body 100, the remote controller 10, or a handle of joystick is manipulated to be inclined in a desired direction, which causes it to be in contact with the contacts located at the desired direction. The contact signal from the contact is provided to the encoder 17, through which the signal is encoded, and then is modulated and transmitted through the antenna to the main body 100.

The signal transmitted from the remote controller 10 is received through the antenna of the main body 100. The received signal is decoded by the decoder 115 coupled to the controller 120 to receive the decoded signal. The controller generates a control signal in response to the decoding signal to move the main body 100, the control signal respectively driving the left and right motor driving portions 132, 134, which results in the movement of the body 100 corresponding to the remote control signal.

For example, a user may incline in a forward direction the handle of the joystick, which causes the adjustable contact 11 to be in contact with the front contact 12 which the contact signal is generated therefrom and then provided to the encoder 17. According to the above mentioned procedures subsequent thereto, both left and right wheels of the main body 100 are rotated to move the body in a forwarded direction.

If a user inclines the handle of the joystick in a left direction for the purpose of moving left the body 100, the left contact 13 is allowed to contact with the adjustable contact 11. According to a contact signal therefrom, the remote control signal is transmitted to the body 100, and only right wheel of the main body is driven in response to a control signal from the controller 120 which drives the right wheel motor driving portion 134.

To move the body 100 in a left and forward direction, a user can manipulate the handle of the joystick in a left and forward direction correspondingly, which causes the contacts 12 and 13 to be in contact with the adjustable contact 11. Then, a remote control signal associated therewith is forwarded to the body 100. The controller 120 drives the right wheel motor driving portion 134 to drive the right wheel at a higher speed, and drives the left wheel motor driving portion 134 to drive the left wheel at a lower speed.

Since the conventional remote controlled vacuum cleaner is provided with the suction inlet 51 at a front lower side of the body 100, this causes the cleaner to be used only under a remote controlled mode. In some cases, a manually operated mode is need depending upon places to be cleaned. However, the above type of conventional cleaner cannot be used under a manual mode, not suitable for a practical use thereof.

SUMMARY OF THE INVENTION

Therefore, it is an object of the present invention to provide a remote controlled vacuum cleaner capable of being operated under a manual operated mode for any places to be cleaned, so as to improve a practical use thereof and convenience for a user.

The above objects are accomplished by a remote controlled vacuum cleaner comprising a motor installed in a chamber inside a main body, for creating a suction, a dust collecting bag installed at a dust collecting compartment, for collecting the dirt and dust sucked by the suction from the motor, left and right wheels for moving the main body, the wheels being driven by left/right wheel driving portions, auxiliary wheel installed at a front lower portion of the main body and rotated together with the rotating right and left wheels, a suction inlet installed at a front lower portion of the main body, which is connected to the dust collecting compartment by way of a suction duct, characterized in that an auxiliary suction inlet is arranged at a front lower portion of the main body, the auxiliary suction inlet being opened or closed in a sliding fashion.

Inside the main body is formed a guide groove for guiding opening/closing means when the auxiliary suction inlet is closed or opened.

Further, the opening/closing means includes a panel for the auxiliary suction inlet which is traveled along the guide groove, and a handle for moving the panel.

According to the above configured vacuum cleaner, there are provided a manual operation of the cleaner by using a hose, thereby providing a convenience for a user and an improved practical use thereof.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENT

A preferred first embodiment according to the present invention will now be described in detail in accordance with the accompanying drawings.

Figure 1:
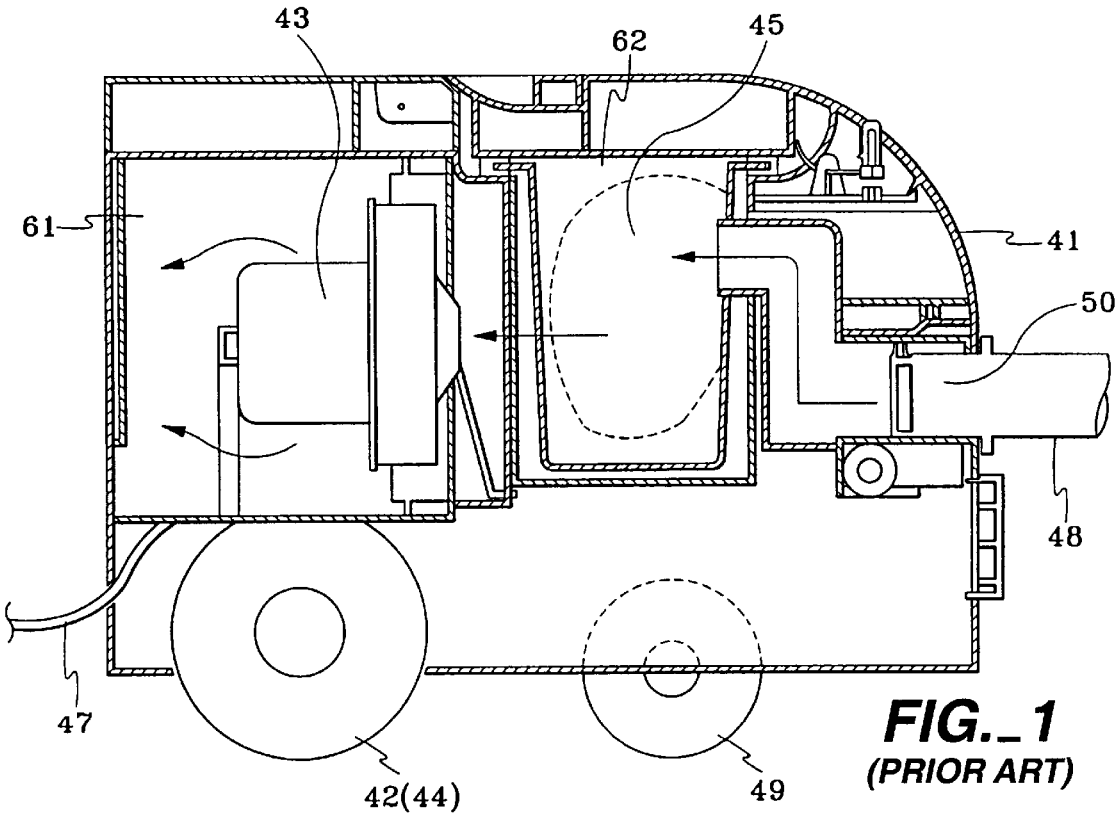
FIG. 1 (PRIOR ART)
FIG. 1 shows a vertical sectional view of a main body of a conventional vacuum cleaner used under a manual operational mode.
Figure 2:
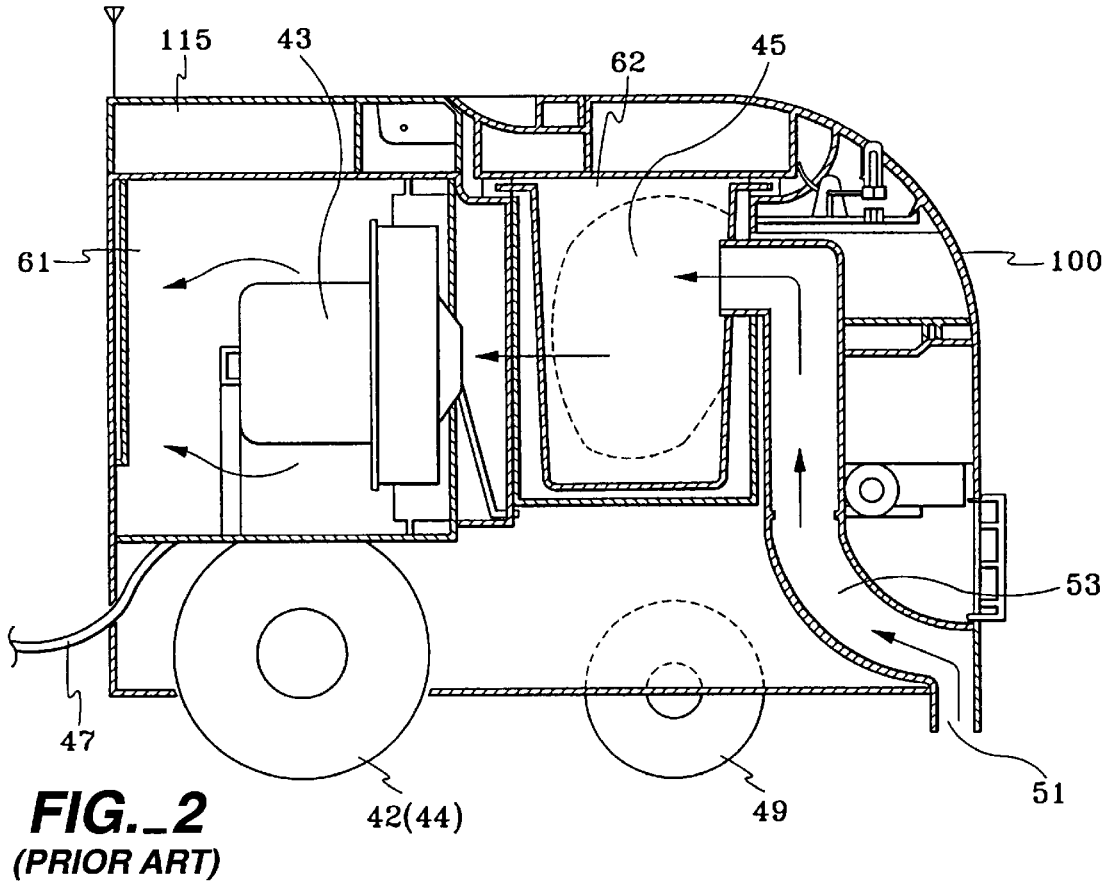
FIG. 2 (PRIOR ART)
FIG. 2 shows a vertical sectional view of a main body of a conventional remote controlled vacuum cleaner used under an automatic operational mode.
Figure 3:
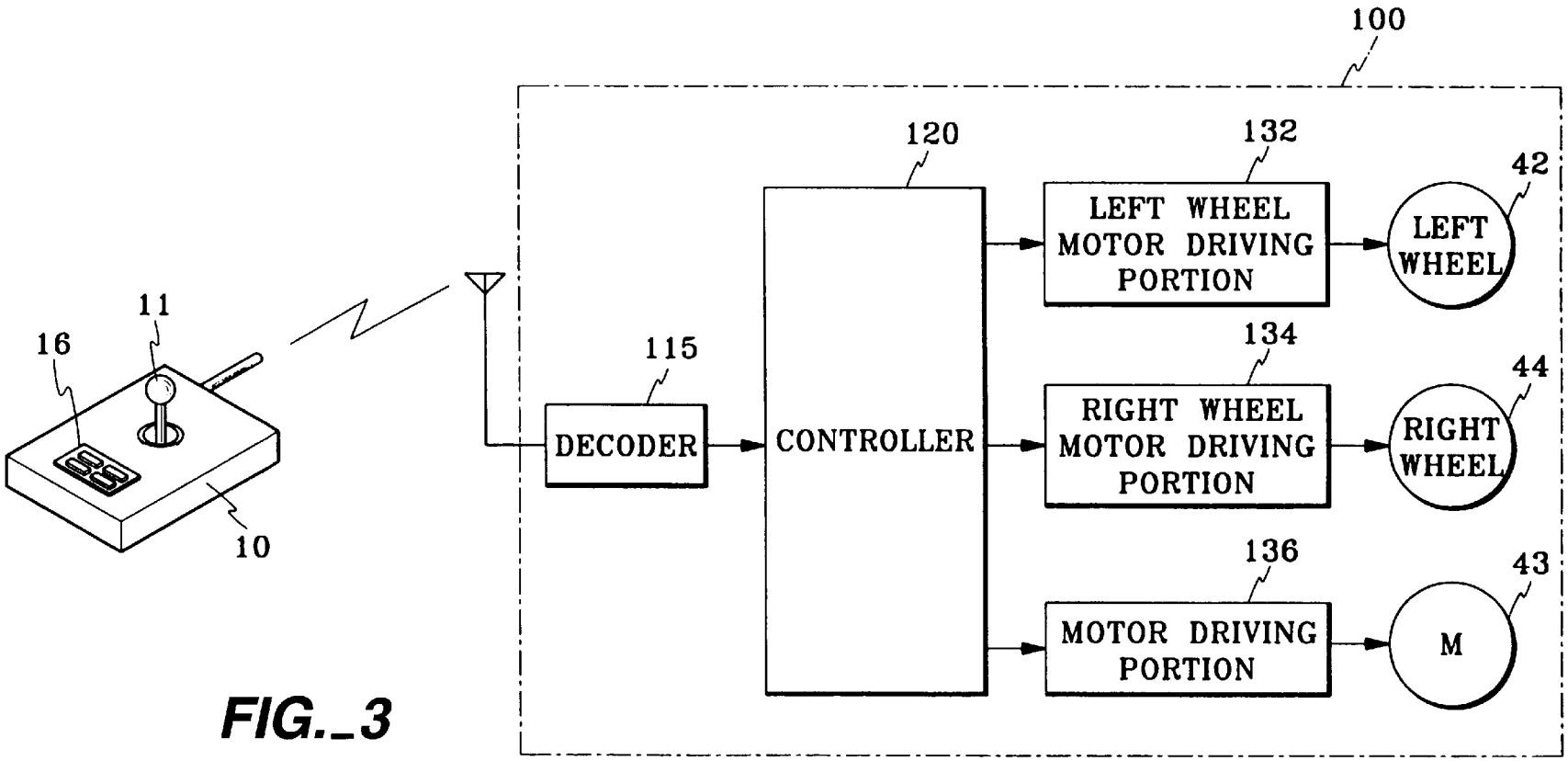
FIG. 3 shows a schematic block diagram of a remote controlled vacuum cleaner in accordance with an embodiment of the present invention.
Figure 4:
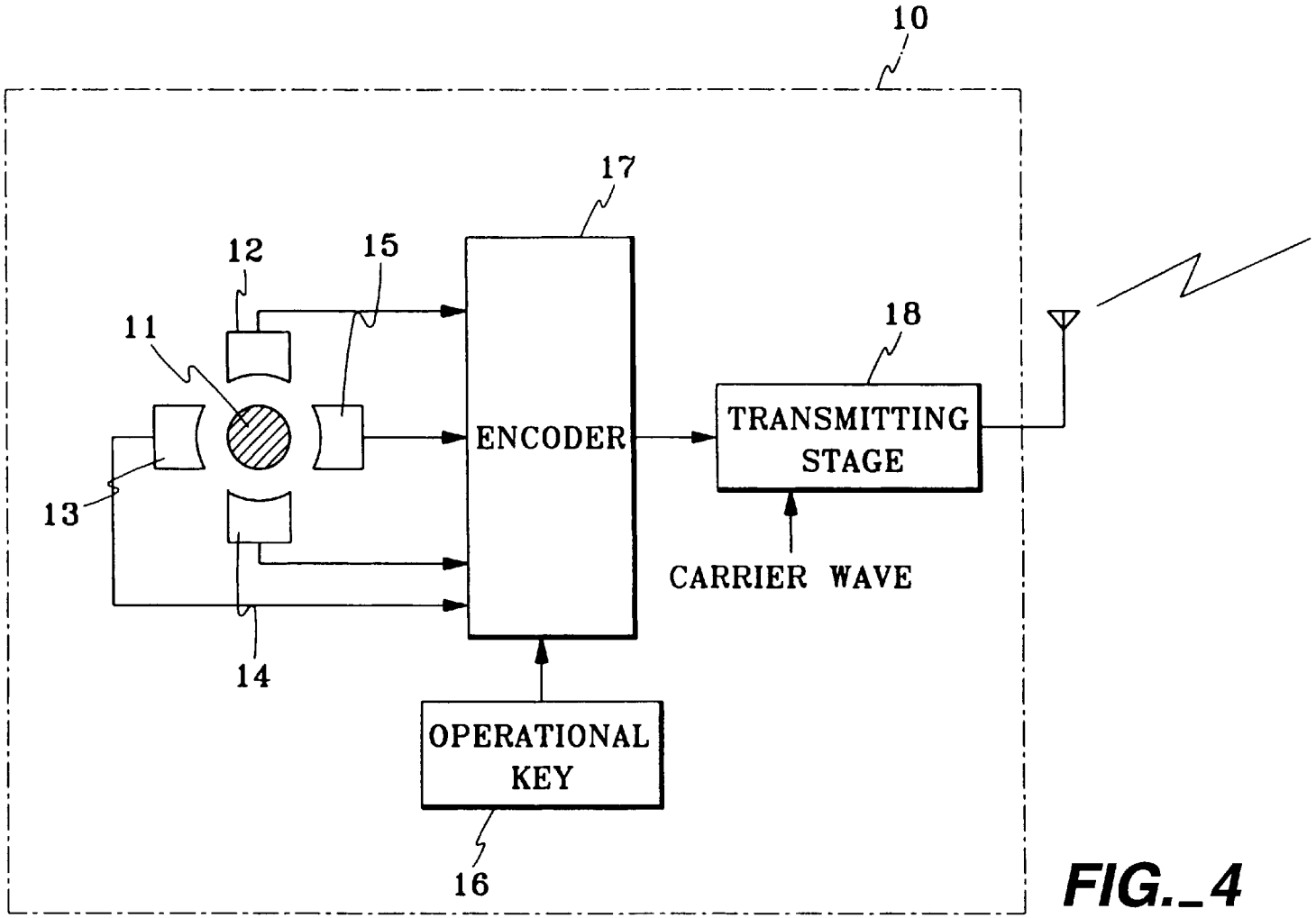
FIG. 4 shows details of a remote controller in FIG. 3.
Figure 5:
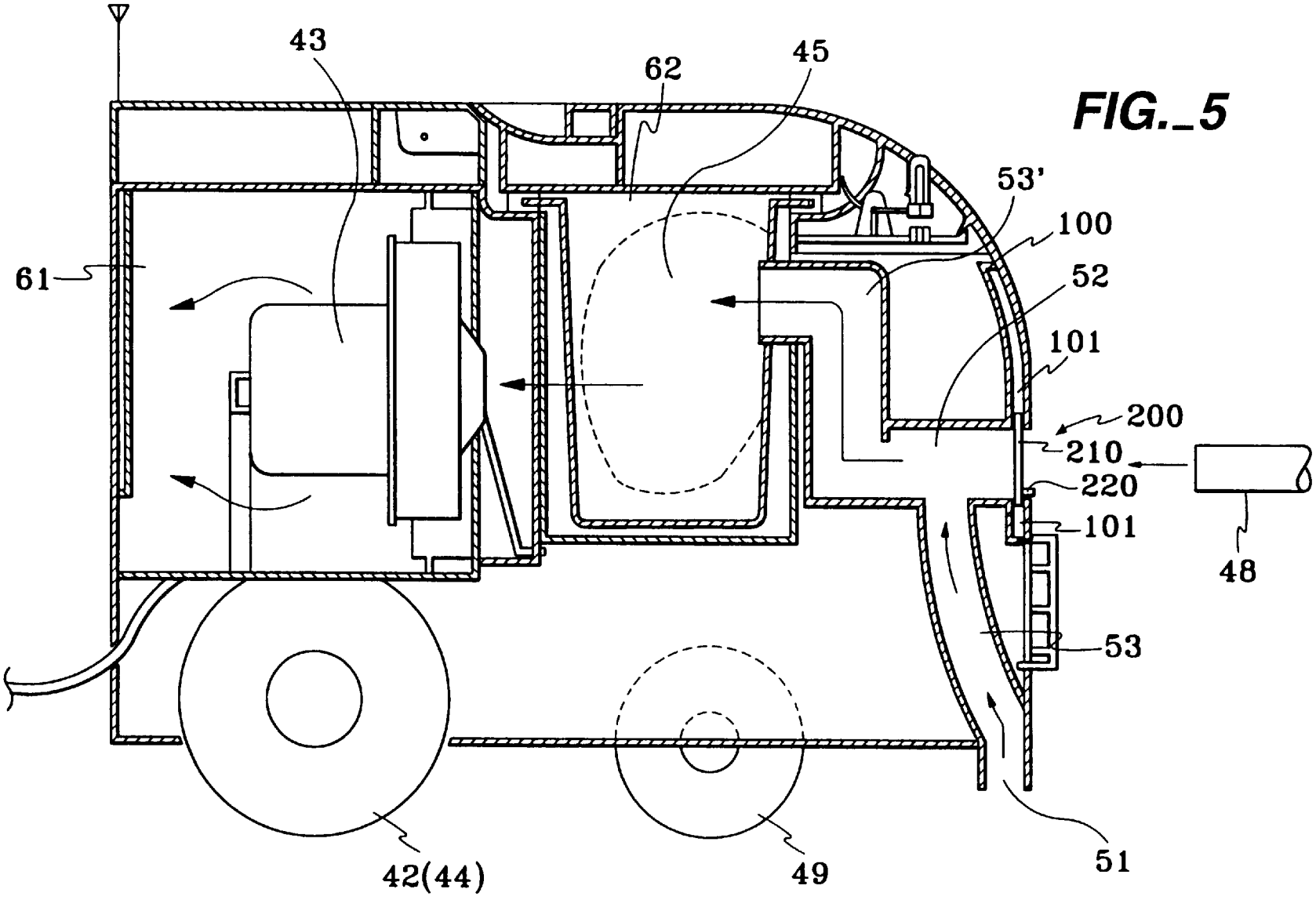
FIG. 5 shows a vertical sectional view of the main body of the remote controlled vacuum cleaner in accordance with the present invention.

FIG. 5 shows a vertical sectional view of the main body of the remote controlled vacuum cleaner in accordance with the present invention. The cleaner has a main body 100 provided therein with a chamber which is provided therein with a motor 43 which creates a suction and of which a side is located a dust collecting compartment 62 having a dust collecting bag 45 used for collecting dust and foreign materials sucked into the body when the motor 43 is activated.

Further, under the motor 43, there is provided left and right wheels 42, 44 arranged at left and right sides of the main body 41, respectively and for moving the main body 41, activated left/right motor driving portions 132, 134. Below the dust collecting compartment 62, there is provided an auxiliary wheel 49 centrally located with respect to the body 41 and for supporting the main body 41. At a lower front side of the body 41 is provided with suction inlet 51 connected to the dust collecting compartment 62 by way of suction ducts 53, 53'.

Here, there is further provided at a front side thereof with an auxiliary suction inlet 52 to install a hose 48 necessary when a manual cleaning operation is made, the auxiliary suction inlet 52 communicating with the suction duct 53'. The auxiliary suction inlet 52 is provided with opening/closing means 200 which is vertically slid to open and close the auxiliary suction inlet 52.

Inside the main body 100, there is provided with a guide groove 101 for guiding the opening/closing means 200 when the auxiliary suction inlet 52 is opened or closed.

Further, the opening/closing means 200 includes a panel 210 for the auxiliary suction inlet which is traveled along the guide groove, and a handle 220 for moving the panel 210.

The operation of the remote controlled vacuum cleaner in accordance with the present invention will be described with reference to FIGS. 5 and 6.

Generally, a user remotely can clean relatively wide areas of such as a floor, or an On-dol floor (the On-dol means the Korean style under-floor heating system) through the use of the remote controlled vacuum cleaner for a convenience for a user.

During the cleaning of areas under the remote control mode, with the auxiliary suction inlet 52 being tightly closed, the suction created by the motor 43 allows the inside of suction ducts 53, 53' to be in a vacuum state, thereby also the opening/closing means 200 completely closing the auxiliary suction inlet 52 due to the suction by the motor 43.

Figure 6:
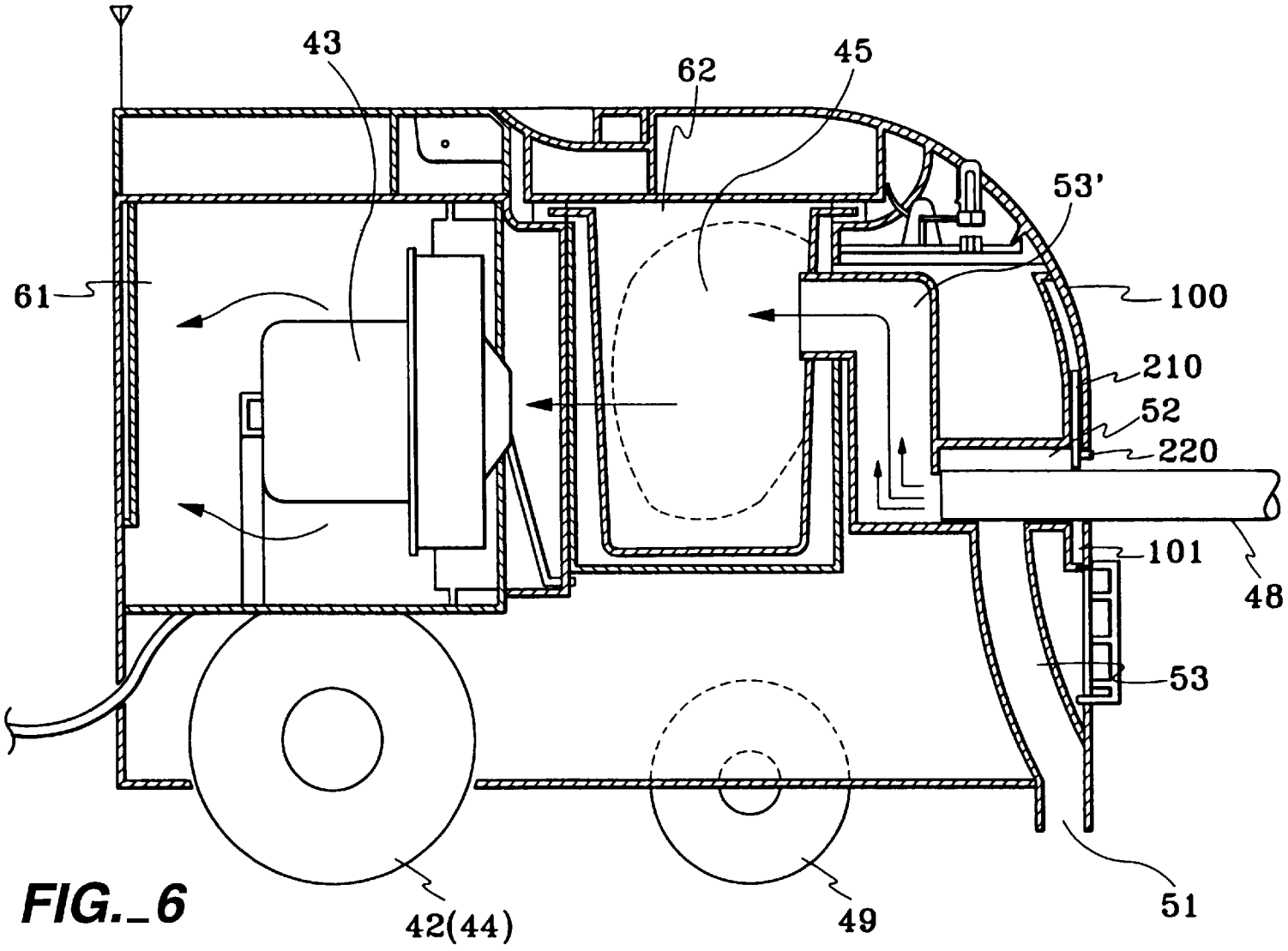
FIG. 6 shows a vertical sectional view showing when the cleaner in FIG. 5 is being used.

As a user intends to clean specific areas, such as corner portions, or top area of the cabinet, which is difficult to clean, the opening/closing means 20 is traveled along the guide groove 101 to open the auxiliary suction inlet 52, as shown in FIG. 6, and then both ends of the hose 48 are inserted into the suction inlet 51 for an installation thereof. This makes it closed the suction duct 53 connected to the dust collecting compartment 62, so that another duct 53' is connected to the inside of the hose 48.

After assembling the cleaner in such a manner as described, electric power is input. Then, the suction by the motor 43 operates through the hose 48, instead of the suction inlet 51, which makes it possible the manual operation of the cleaner.

Further, when the cleaner is to be used under an automatic mode, the hose 48 is at first separated from the auxiliary suction inlet 52, followed by the downward movement of the opening/closing means 200 having been moved upstream of the guide groove 101. Thus, the auxiliary suction inlet 52 is closed by the panel 210, thereby to open the suction duct 53, allowing for a remote controlled cleaning.

According to the foregoing, the present invention combines a manual operation with an automatic operation, provides a convenience for a user and improves a practical use, as well as the value of product.

What is claimed is:

1. A vacuum cleaner that is operable in a remote control mode and a manual mode, comprising:

a main body having a first and a second side facing different directions, a first suction inlet formed on the first side and adapted to receive a hose for operation in the manual mode, a second suction inlet formed on the second side for operation in the remote control mode, wherein the second suction inlet communicates with the first suction inlet so that the hose blocks the second suction inlet when the hose is inserted into the first suction inlet, a guide agroove formed on the main body, a panel, and a handle, for moving the panel along the guide groove between a closed position and an open position, wherein the panel in the closed position prevents the hose from being, inserted in the first suction inlet, and wherein the panel in the open position allows the hose from being inserted into the first suction inlet.

2. The vacuum cleaner of claim 1, wherein the second side is positioned close to the ground.

* * * * *